US006899573B2

(12) United States Patent
Saka et al.

(10) Patent No.: US 6,899,573 B2
(45) Date of Patent: May 31, 2005

(54) COUPLED TERMINAL UNIT AND A CONNECTOR ASSEMBLING METHOD USING THE SAME

(75) Inventors: Yukinori Saka, Yokkaichi (JP); Eiji Saijo, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/625,159

(22) Filed: Jul. 23, 2003

(65) Prior Publication Data

US 2004/0132323 A1 Jul. 8, 2004

(30) Foreign Application Priority Data

Jul. 24, 2002 (JP) ..... 2002-215728

(51) Int. Cl.[7] ..... H01R 13/02
(52) U.S. Cl. ..... 439/885; 206/717
(58) Field of Search ..... 439/885, 937; 206/713–717

(56) References Cited

U.S. PATENT DOCUMENTS 4,428,642 A * 1/1984 Schwindt et al. ..... 439/885
4,676,580 A * 6/1987 Takahashi ..... 439/885
5,060,372 A * 10/1991 Capp et al. ..... 29/883
5,848,920 A * 12/1998 Klein et al. ..... 439/885
6,083,060 A * 7/2000 Chen et al. ..... 439/885
6,186,843 B1 * 2/2001 Chen et al. ..... 439/885

FOREIGN PATENT DOCUMENTS

JP 5-3070 1/1993

* cited by examiner

*Primary Examiner*—P. Austin Bradley
*Assistant Examiner*—X. Chung-Trans
(74) *Attorney, Agent, or Firm*—Gerald E. Hespos; Anthony J. Casella

(57) ABSTRACT

A coupling terminal unit (30) has terminal fittings (20) coupled in parallel by a coupling portion (31) and is stamped from a metallic plate so that the coupling portion (31) is extendible in an arranging direction of the terminal fittings (20). An arrangement pitch (A) of the terminal fittings (20) is narrower than an arrangement pitch of the terminal insertion holes (14). Then, since the coupled terminal unit (30) is stamped out such that the arrangement pitch (A) of the terminal fittings (20) is narrower than that of the terminal insertion holes (14), unnecessary portions between the terminal fittings (20) can be reduced. Thus, the utilization efficiency of a material for the production of the coupled terminal unit (30) can be improved.

9 Claims, 11 Drawing Sheets

COUPLED TERMINAL UNIT AND A CONNECTOR ASSEMBLING METHOD USING THE SAME

BACKGROUND OF THE INVENTION

1. Field of the Invention

The invention relates to a coupled terminal unit and a connector assembling method using such a coupled terminal unit.

2. Description of the Related Art

Japanese Unexamined Patent Publication No. 5-3070 and FIG. 12 herein disclose a circuit board connector. With reference to FIG. 12, the circuit board connector generally is assembled by inserting terminal fittings 3 side by side into a plurality of terminal insertion holes 2 in a housing 1 made of, e.g. a synthetic resin. For a better assembling efficiency, it is desired to insert the terminal fittings 3 into the terminal insertion holes 2 at once instead of one by one. Thus, the terminal fittings 3 are inserted as a coupled terminal unit 5 obtained by connecting the terminal fittings 3 with each other by a coupling portion 4.

A pitch between the terminal fittings 3 in this coupled terminal unit 5 is the same as that of cavities of a mating connector housing, i.e. the arrangement pitch of the terminal insertion holes 2, so that the terminal fittings 3 can be inserted into the terminal insertion holes 2 at once while being kept coupled to each other. The terminal fittings 3 are separated from the coupling portion 4 to become individual pieces after being inserted into the terminal insertion holes 2.

It has been thought that the pitch of the terminal fittings 3 in the coupled terminal unit 5 has to be the same as that of the terminal insertion holes 2. Thus, the pitch of the terminal insertion holes 2 has been a hindrance in efficiently stamping the terminal fittings 3 out from a material.

The invention was developed in view of the above problem, and an object of the invention is to improve the utilization efficiency of a material used for a coupled terminal unit while connector assembling efficiency is maintained.

SUMMARY OF THE INVENTION

The invention relates to a coupled terminal unit in which a plurality of terminal fittings are coupled substantially in parallel by at least one coupling portion and are to be separately arranged in a connector housing by cutting off the coupling portion after being at least partly inserted into terminal insertion holes formed in the connector housing. The coupling portion is formed to be extendible or elongateable or stretchable in an arranging direction of the terminal fittings of the coupled terminal unit. An arrangement pitch of the terminal fittings is narrower than an arrangement pitch of the terminal insertion holes in a cut- or stamped-out state of the coupled terminal unit from a conductive (preferably metallic) plate. The arrangement pitch of the terminal fittings becomes substantially equal to that of the terminal insertion holes by extending or elongating or stretching the extendible portion.

The arrangement pitch of the terminal fittings in the cut- or stamped-out coupled terminal unit is narrower than that of the terminal insertion holes in the connector housing. Thus, unnecessary portions between the terminal fittings can be reduced to improve the utilization efficiency of a material used for the production of the coupled terminal unit.

The coupling portion is formed into such an embossed or wavy shape as to project along the thickness direction of the coupled terminal unit when the coupled terminal unit is cut or stamped out. Thus, the coupling portion is slackened beforehand, but is easy to extend or to be extended or stretched. By preferably pressing the coupling portion in the thickness direction of the coupled terminal unit, the arrangement pitch of the terminal fittings can be easily widened. Further, the arrangement pitch of the terminal fittings can be adjusted by a pressing pressure. Therefore, connectors having different pitches of the terminal insertion holes can be dealt with.

The coupling portion preferably connects adjacent terminal fittings at intermediate positions thereof.

The terminal fittings may each comprise a widened portion that is wider than other portions of the terminal fittings. The coupling portion may connect adjacent terminal fittings at a position at or near the widened portions.

The terminal fittings may each comprise a bulging portion to be engaged with the connector housing, and the coupling portion may connect adjacent terminal fittings at a position near the bulging portions thereof.

The invention also relates to a connector assembling method for a connector. The method comprises providing a coupled terminal unit as described above having a plurality of terminal fittings coupled by at lest one coupling portion such that an arrangement pitch of the terminal fittings is narrower than an arrangement pitch of terminal insertion holes in a connector housing of the connector. The method then comprises extending or stretching or elongating the coupling portion(s) in an arranging direction of the terminal fittings of the coupled terminal unit to thereby make the arrangement pitch of the terminal fittings substantially equal to that of the terminal insertion holes and at least partly inserting the terminal fittings of the coupled terminal unit into the terminal insertion holes.

The connector assembling method preferably further comprises a step of cutting off the coupling portion(s) after the terminal fittings are at least partly inserted into terminal insertion holes.

Preferably, the arrangement pitch of the terminal fittings is made substantially equal to that of the terminal insertion holes upon inserting the terminal fittings of the coupled terminal unit into the terminal insertion holes.

The invention also relates to a connector assembling method for, after a plurality of terminal fittings of a coupled terminal unit coupled in parallel by a coupling portion are inserted into a plurality of terminal insertion holes formed in a connector housing, separately arranging the terminal fittings in the connector housing by cutting off the coupling portion. The coupled terminal unit is stamped out from a metallic plate such that an arrangement pitch of the terminal fittings is narrower than that of the terminal insertion holes, and the coupling portion is extended in an arranging direction of the terminal fittings of the coupled terminal unit to make the arrangement pitch of the terminal fittings equal to that of the terminal insertion hole upon inserting the terminal fittings of the coupled terminal unit into the terminal insertion holes.

Preferably, the coupling portion of the coupled terminal unit having the terminal fittings arranged at the narrower pitch is pressed into a wavy shape to project along the thickness direction of the coupled terminal unit.

The coupled terminal unit is provided such that the terminal fittings each comprise a widened portion that wider than other portions of the terminal fittings, and that the coupling portion connects adjacent terminal fittings at a position at or near the widened portions thereof.

Most preferably, the coupling portions are extended by being pressed substantially along the thickness direction.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIG. 8 is a partial section showing a state before the terminal fittings of the coupled terminal unit arranged at the wider pitch are pressed in.

FIG. 9 is a partial section showing a state where the terminal fittings of the coupled terminal unit are pressed in.

FIG. 11 is a partial section showing a state where the terminal fittings are completely pressed in.

FIG. 12 is a partial section showing a state where terminal fittings of a prior art coupled terminal unit are pressed in.

DETAILED DESCRIPTION OF THE PREFERRED EMBODIMENTS

One preferred embodiment of the present invention is described with reference to FIGS. 1 to 11.

Figure 1:
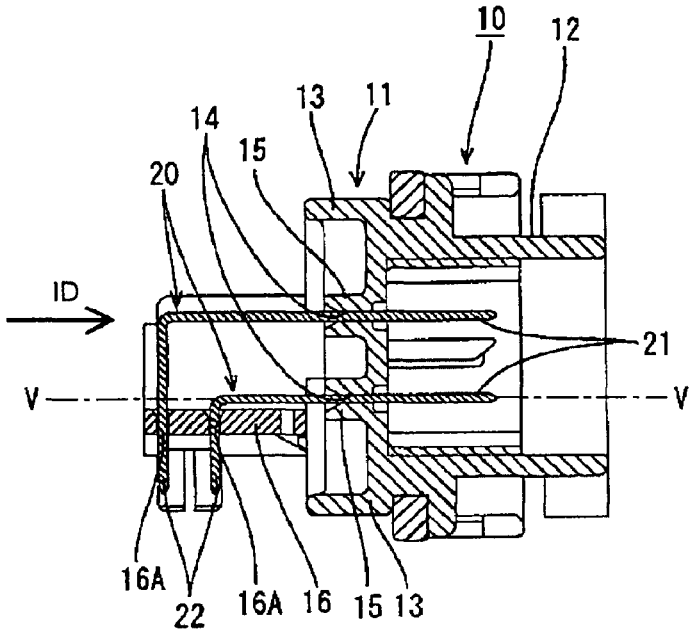
FIG. 1 is a side view in section of a circuit board connector assembled by a connector assembling method according to the invention.

First, a connector assembled by a connector assembling method according to a preferred embodiment of the present invention is described. Identified by 10 in FIG. 1 is a circuit board connector assembled by a preferred embodiment of the inventive method. It should be noted that a mating side with an unillustrated mating connector (right side of FIG. 1) is referred to as front, direction normal to the plane of FIG. 1 is referred to as transverse direction and reference is made to FIG. 1 concerning vertical direction for the description of the circuit board connector 10.

The circuit board connector 10 is provided with a connector housing 11 and one or more, preferably a plurality of terminal fittings 20. The connector housing 11 is made e.g. of a synthetic resin, and includes an engaging portion 12 preferably substantially in the form of a rectangular tube extending forward. The engaging portion 12 is engageable with an unillustrated mating connector. A surrounding wall 13 is provided at the outer periphery of the rear surface of the connector housing 11.

One or more terminal insertion holes 14 are formed, preferably at a transversely substantially even interval, at one or more stages, preferably at two upper and lower stages, to penetrate the back wall of the engaging portion 12 in forward and backward directions. One or more bosses 15 project from the rear surface of the connector housing 11 substantially in conformity with the terminal insertion holes 14, and the terminal insertion holes 14 are gradually widened toward the rear end at the rear surfaces of the respective bosses 15.

Figure 2:
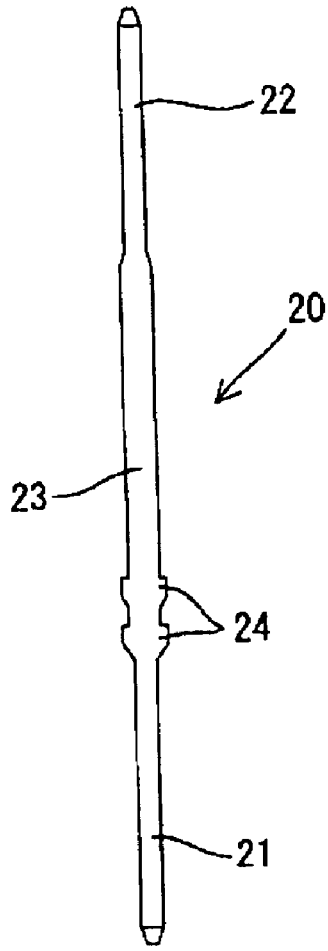
FIG. 2 is a plan view of a terminal fitting used in the inventive connector assembling method.

The terminal fittings 20 are or can be at least partly pressed into the terminal insertion holes 14 from an inserting direction ID, preferably from behind the connector housing 11. There preferably are two kinds of terminal fittings in the form of rectangular bars having different lengths and made of a conductive material such as metal having an excellent electrical conductivity. The longer terminal fittings 20 are at least partly pressed or fitted or inserted into the terminal insertion holes 14 at the upper stage of the connector housing 11 while the shorter terminal fittings 20 are at least partly pressed or fitted or inserted into the terminal insertion holes 14 at the lower stage. Since both types of the terminal fittings 20 have the substantially same structure despite their different lengths, the shorter terminal fitting 20 shown in FIG. 2 is described below.

One end portion of each terminal fitting 20 serves as a terminal connecting portion 21 which projects into the engaging portion 12 as shown in FIG. 1, and the terminal connecting portion 21 is brought or bringable into contact with a mating terminal fitting of the mating connector to establish an electrical connection. The other end portion of each terminal fitting 20 projects out from the rear surface of the connector housing 11 and is bent substantially normal substantially into L-shape, and the leading end thereof serves as a board connecting portion 22. The bottom ends of the board connecting portions 22 preferably are arrayed in one or more rows, preferably two front and rear rows, at the substantially same height position, and are or can be electrically connected with circuits of an unillustrated circuit board. A portion of each terminal fitting 20 between the terminal connecting portion 21 and the board connecting portion 22 is formed into a widened portion 23. One or more, preferably two bulging portions 24 are provided one after the other at a position of the terminal fitting 20 corresponding to the boss 15 and/or located between the widened portion 23 and the terminal connecting portion 21. Both bulging portions 24 are tapered toward their edges closer to the terminal connecting portion 21, so that the terminal fitting 20 can be pressed or fitted or inserted into the terminal insertion hole 14 from the terminal connecting portion 21, and the opposite edges thereof extend in a direction substantially normal to the length or longitudinal extension of the terminal fitting 20 to prevent the terminal fitting 20 inserted into the terminal insertion hole 14 from coming out.

An alignment plate 16 is mounted at a lower part of the rear surface of the connector housing 11 so as to be arranged substantially normal to the board connecting portions 22 (so as to be substantially horizontal or parallel to the circuit board). The alignment plate 16 is inserted or arranged from below and is so held onto the connector housing 11 so as not to come off when reaching a specified position. Alignment holes 16A for substantially aligning the board connecting portions 22 of the terminal fittings 20 inserted therethrough (vertically) penetrate the alignment plate 16. The alignment holes 16A are formed in front and rear, rows in the alignment plate 16, wherein the terminal fittings 20 at the lower stage are at least partly inserted through the alignment holes 16A in the front row and those at the upper stage are at least partly inserted through the alignment holes 16A in the rear row.

Figure 3:
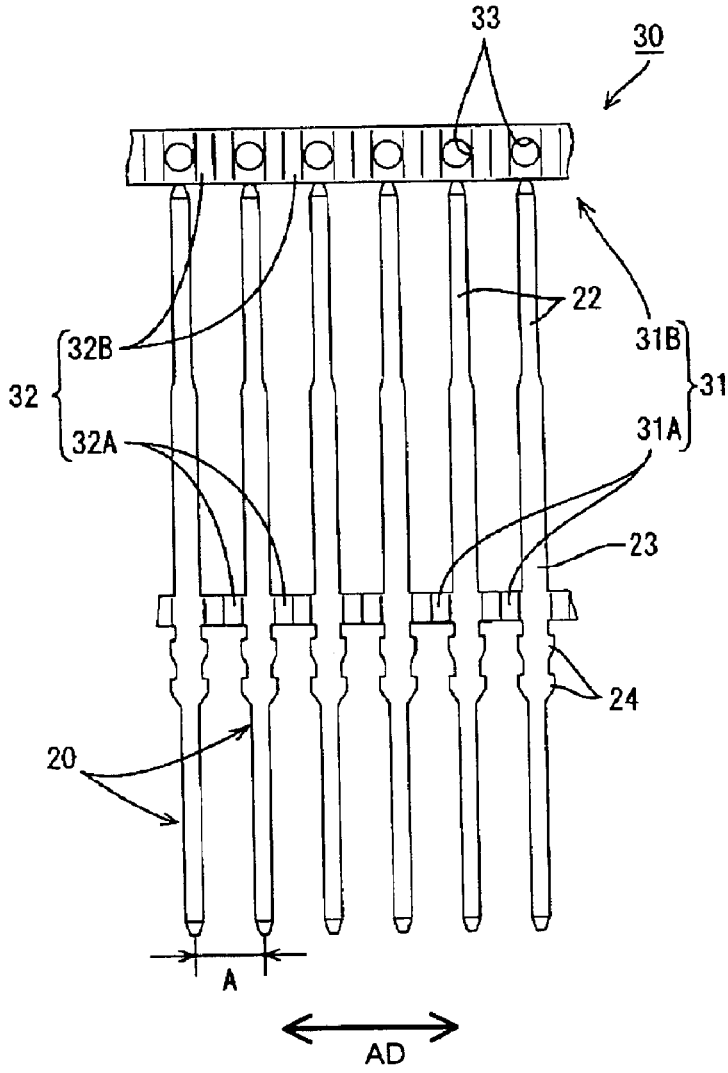
FIG. 3 is a plan view of an inventive coupled terminal unit having terminal fittings arranged at a narrower pitch.
Figure 4:
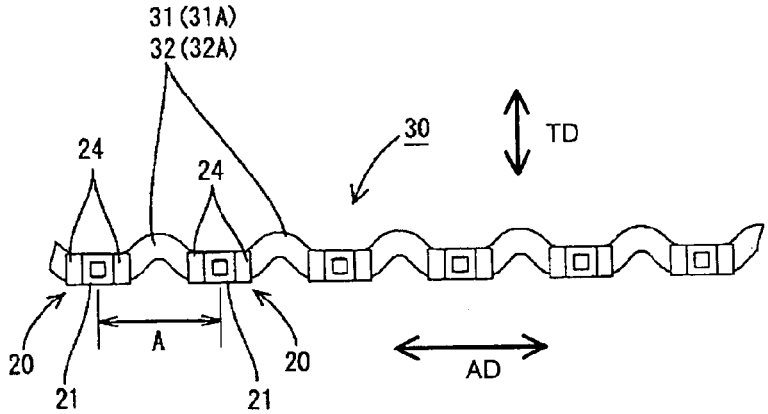
FIG. 4 is a front view of the coupled terminal unit of FIG. 3.
Figure 5:
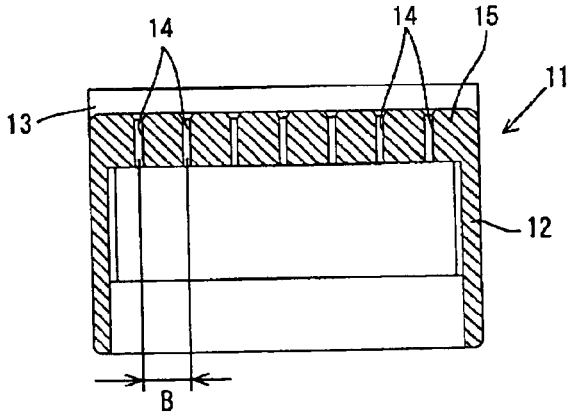
FIG. 5 is a partial section along 5—5 of FIG. 1 showing a connector housing before assembling.
Figure 6:
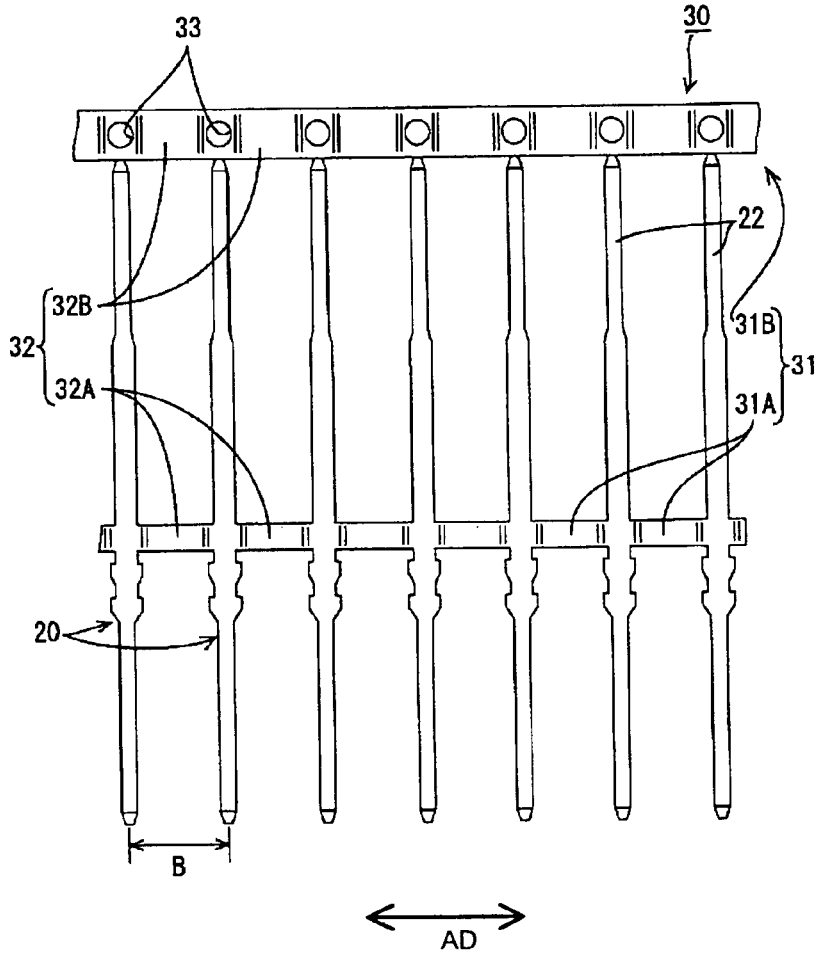
FIG. 6 is a plan view of the inventive coupled terminal unit having the terminal fittings arranged at a wider pitch.
Figure 7:
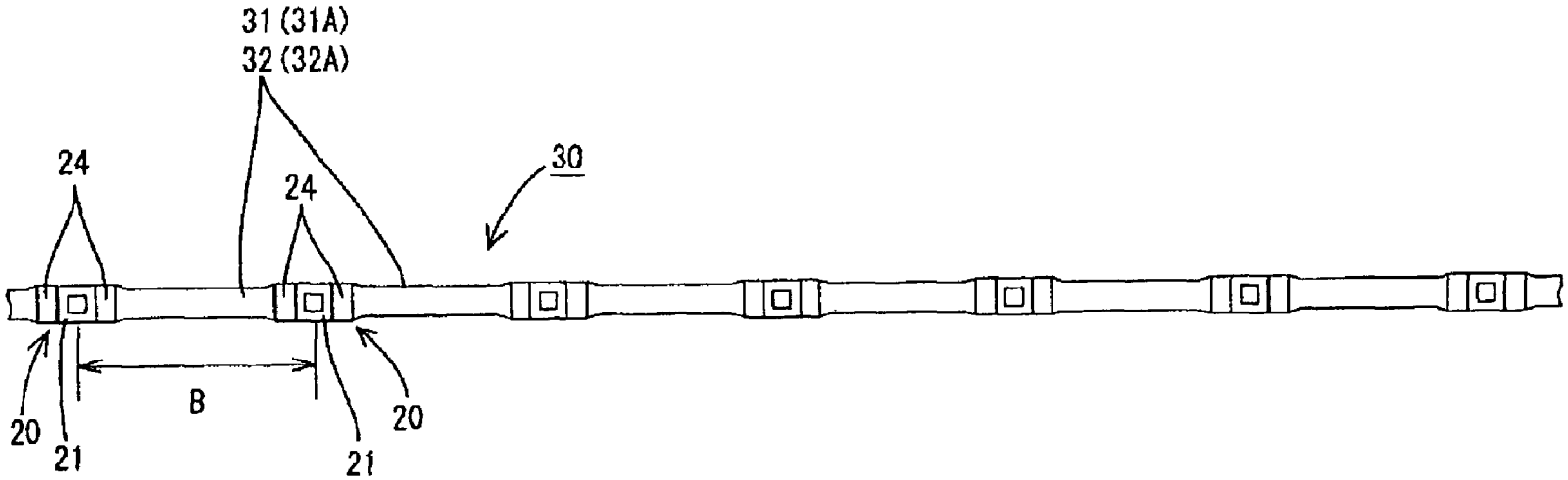
FIG. 7 is a front view of the coupled terminal unit of FIG. 6.

Before being pressed into the terminal insertion holes 14 of the connector housing 11, a plurality of terminal fittings 20 are in the form of a coupled terminal unit 30. In the following description, a plurality of (e.g. seven) terminal fittings 20 are coupled as shown in FIGS. 3 and 4.

The coupled terminal unit 30 is produced by stamping or cutting a conductive (metallic) plate out, and the adjacent terminal fittings 20 are coupled by a coupling portion 31. The coupling portion 30 is comprised of middle coupling portions 31A provided at one or more intermediate portions of the terminal fittings 20, preferably at portions of the widened portions 23 near or at the bulging portions 24, i.e. substantially in the middles of the terminal fittings 20, and an end coupling portion 31B provided at the leading ends of the board connecting portions 22. The terminal fittings 20 are coupled substantially in parallel with the adjacent terminal fittings 20 at the substantially middle portions and the leading ends of the board connecting portions 22.

The coupled terminal unit 30 has the terminal fittings 20 thereof at least partly inserted into the terminal insertion holes 14 at once, and is stamped or cut out from the conductive (metallic) plate such that the terminal fittings 20 are arranged at an arrangement pitch A (see FIGS. 3 and 4) set smaller than an arrangement pitch B (see FIG. 5) of the terminal insertion holes 14. The terminal fittings 20 of the coupled terminal units 30 are pressed or fitted into the terminal insertion holes 14 while being arranged substantially in parallel at a wider pitch substantially equal to the arrangement pitch B (see FIG. 6 and 7).

Thus, the coupling portion 31 of the coupled terminal units 30 is formed with extendible portions 32 extendible at least in the arranging direction AD of the terminal fittings 20 of the coupled terminal units 30 preferably by being pressed or stamped. Specifically, the middle coupling portions 31A are entirely embossed from below in FIG. 4 to project more up than the terminal fittings 20 or to project outside of the plane containing the terminal fittings 20, thereby being formed into wavy embossed middle extendible portions 32A (i.e. having a wavy cross-sectional shape when seen along the longitudinal section of the middle extendible portions 32A or the arrangement direction AD, see FIG. 4), and are slackened between the terminal fittings 20. The end coupling portion 31B is formed into a strip or band shape and formed with perforations 33 substantially in conformity with the leading ends of the board connecting portions 22. End extendible portions 32B are formed between the perforations 33 substantially in the same manner as the middle extendible portions 32A.

On the other hand, to hold the coupled terminals 30 at the wider pitch, the extendible portions 32 are pressed in the thickness direction TD of the coupled terminal unit 30 to change their shape from wavy shape to a less-wavy shape, preferably to a substantially flat shape. Thus, the extension along the thickness direction TD of the extendible portions 32 is reduced. As a result, the arrangement pitch of the terminal fittings 20 becomes substantially equal to the arrangement pitch B of the terminal insertion holes 14.

Next, one exemplary method for assembling the circuit board connector 10 is described.

First, a rolled terminal band (not shown) including a plurality of coupled terminal units 30 having terminal fittings 20 arranged at the narrower arrangement pitch is produced by successively stamping or cutting a conductive (metallic) plate out. In this terminal band, the shorter terminal fittings 20 to be at least partly inserted into the terminal insertion holes 14 at the lower stages of the connector housings 11 are connected one after another.

Next, the terminal band is transported to an assembly line where the terminal fittings 20 are to be mounted into the circuit board connectors 10. A coupled terminal unit 30 having a number of terminal fittings 20 necessary for the circuit board connector 10 is cut off from the terminal band. The extendible portions 32 of the cut-off terminal unit 30 are pressed by a die having suitable projections, whereby the front and rear sides thereof are squeezed and deformed. Then, the extendible portions 32 become flatter or less wavy, preferably substantially flat, and are correspondingly extended or elongated or stretched, and the terminal fittings 20 come to be arranged at the wider pitch substantially equal to the pitch B of the terminal insertion holes 14 (see FIGS. 6, 7 and 8). The coupled terminal unit 30 may be cut off after the terminal band is pressed to arrange the terminal fittings 20 at the wider pitch.

Figure 8:
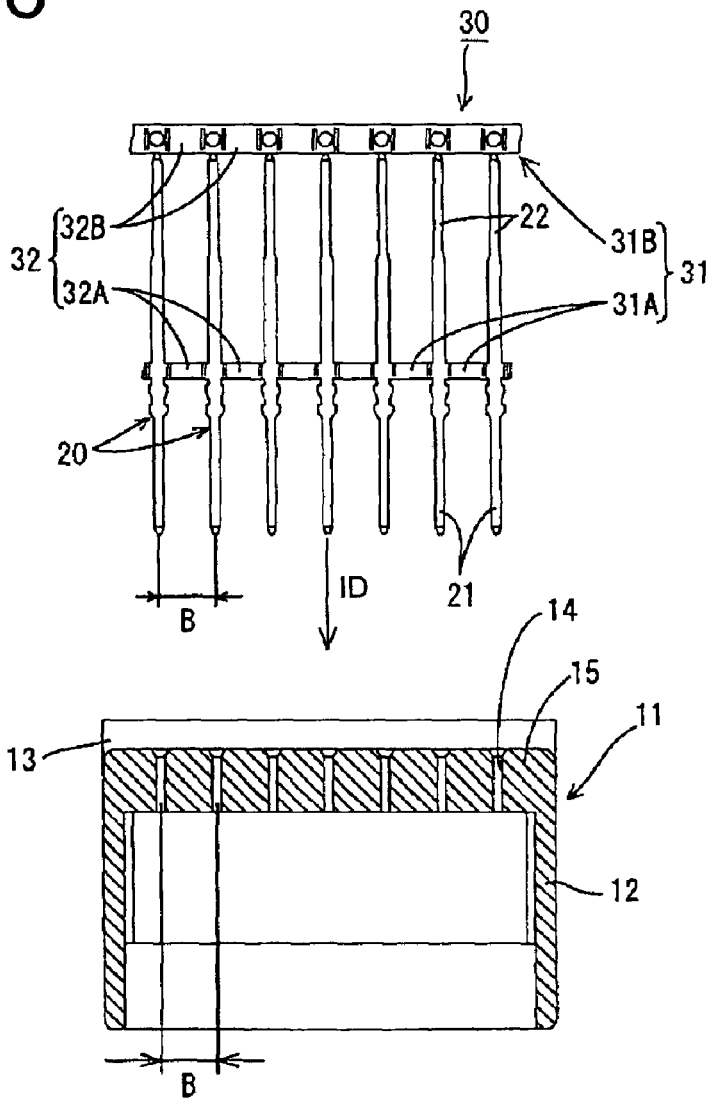
Figure 9:
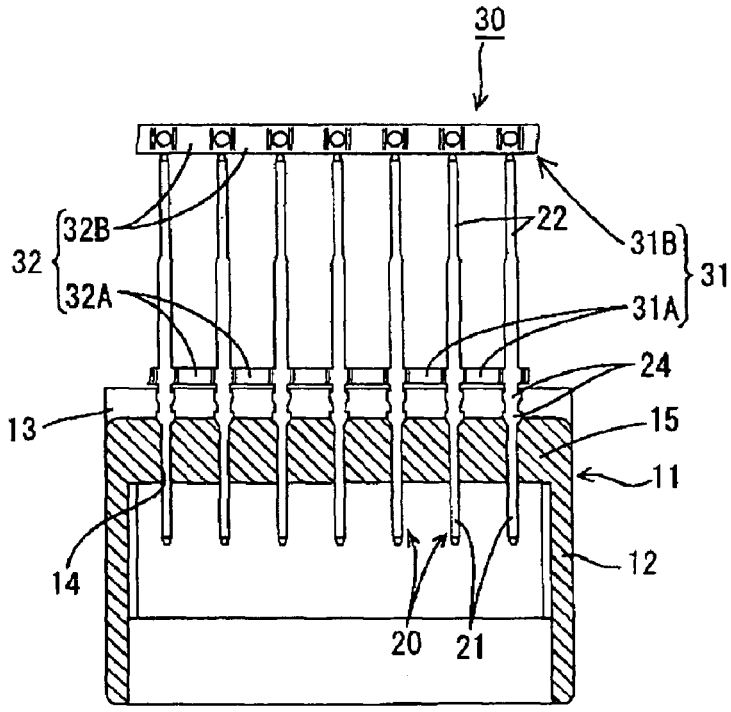
Figure 10:
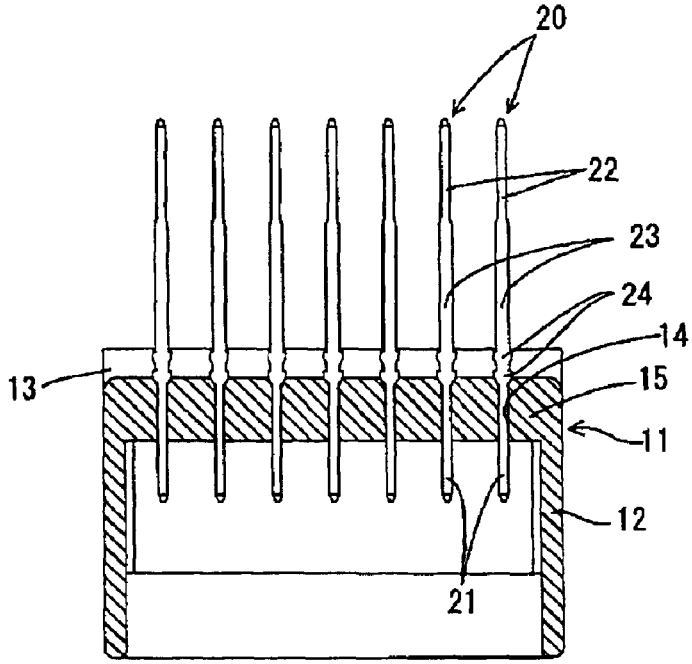
FIG. 10 is a partial section showing a state where a coupling portion is separated.

The terminal fittings 20 of the coupled terminal unit 30 arranged at the wider pitch are pressed into the terminal insertion holes 14 at the lower stage of the connector housing 11 in the inserting direction ID; preferably from behind, (from above in FIG. 8). With the tapered parts of the bulging portions 24 of the terminal fittings 20 located at the front side (lower side in FIG. 8) with respect to inserting direction ID (see FIG. 9), the insertion of the coupled terminal unit 30 is interrupted. The coupling portion 31 is cut and removed by an unillustrated coupling portion cutting jig in this state, so that the respective terminal fittings 20 are independent of each other as shown in FIG. 10. Upon cutting the coupled terminal unit 30, the opening edge of the surrounding wall 13 of the connector housing 11 is located before the coupling portion 31 so as not to interfere with the cutting operation of the coupling portion cutting jig.

Figure 11:
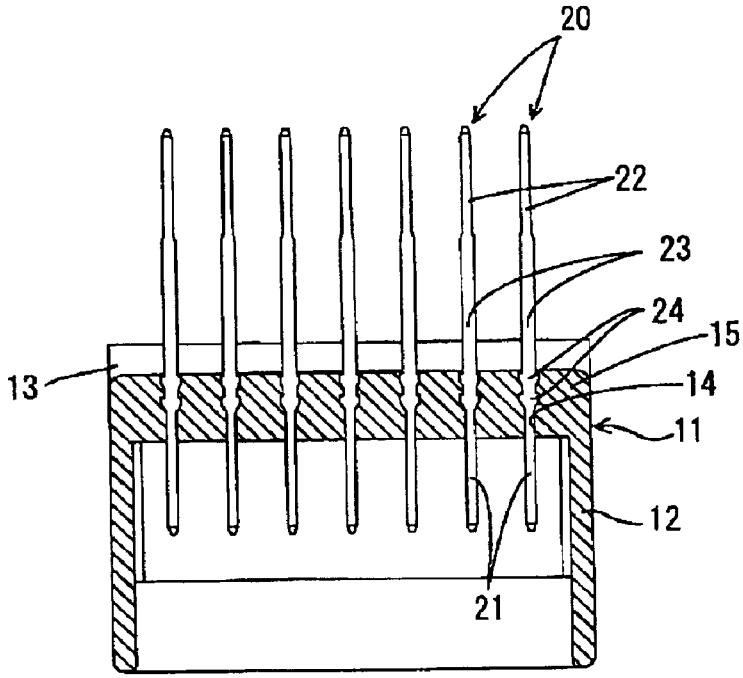
Figure 12:
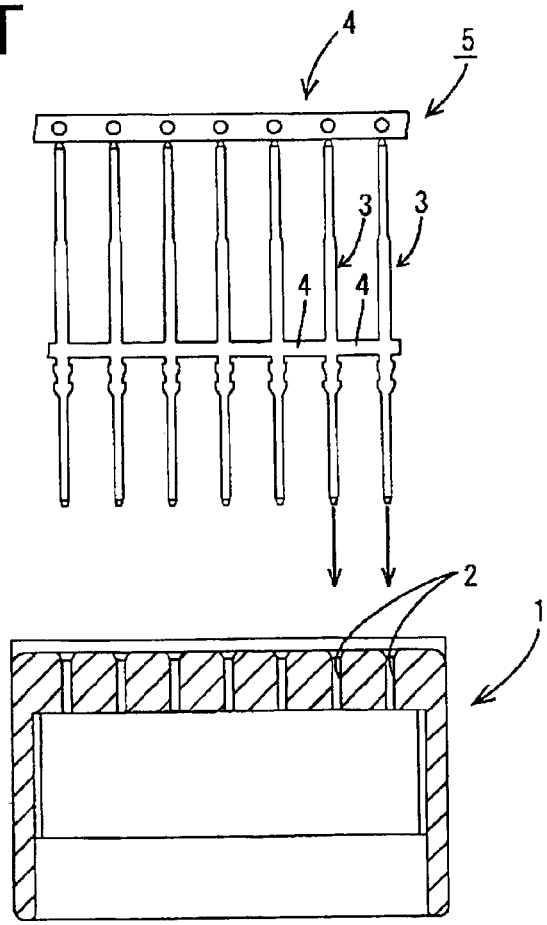
FIG. 12 PRIOR ART

The independent terminal fittings 20 are further pressed forward into the connector housing 11 so that both bulging portions 24 of each terminal fitting 20 can be pressed into the boss 15 as shown in FIG. 11. After the terminal fittings 20 are completely pressed in, the rear end sides of the terminal fittings 20 are bent at an angle, preferably substantially normal, to substantially extend toward the bottom of the circuit board connector 10.

Similarly, a coupled terminal unit 30 including longer terminal fittings 20 is pressed to press the terminal fittings 20 into the terminal insertion holes 14 at the upper stage of the connector housing 11. Upon bending the rear end sides of the terminal fittings 20, the leading ends of the board connecting portions 22 of all the terminal fittings 20 are substantially aligned with respect to height direction.

The alignment plate 16 is or can be mounted into the connector housing 11 from the leading end side, preferably from below, to at least partly insert the board connecting portions 22 of the terminal fittings 20 through the alignment holes 16A, thereby substantially aligning the board connecting portions 22. In this way, the circuit board connector 10 is assembled.

As described above, the coupled terminal unit 30 is stamped or cut out such that the arrangement pitch of the terminal fittings 20 is narrower than the arrangement pitch of the terminal insertion holes 14 of the connector housing 11. Thus, a smaller amount of the conductive (metallic plate) is used as compared to a case where the same number of the coupled terminal units having the terminal fittings 20 arranged at the pitch B are formed and, hence, the conductive (metallic) plate is to be wasted less. Therefore, the utilization efficiency of the material can be improved.

The present invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the invention is applied to the circuit board connector in the foregoing embodiment, it is also applicable to other types of connectors. For example, it can be applied to an intermediate connector and connectors having substantially straight terminal fittings. Alternatively, a joint connector may be assembled without separating some of a plurality of coupling portions 31.

Although the extendible portions 32 project only at one side with respect to the thickness direction TD of the coupled terminal unit 30 in the foregoing embodiment, the shape thereof is not particularly restricted provided they can be extended or stretched substantially in the arranging direction AD of the terminal fittings 20 of the coupled terminal unit 30. For example, the extendible portions 32 may project toward both sides of the coupling terminal unit 30 or may be substantially flat without projecting. Furthermore, the cross-sectional area of the extendible portions 32 may become smaller or remain substantially the same when being extended or stretched.

What is claimed is:

1. A coupled terminal unit having a plurality of terminal fittings coupled by at least one coupling portion so that the terminal fittings are substantially parallel and in a common plane, the terminal fittings being separately arrangeable in a connector housing by cutting off the coupling portion after being inserted into terminal insertion holes (14) formed in the connector housing, wherein:

the coupling portion is formed into a wavy shape extending out of the plane of the terminal fittings and is extendible in an arranging direction of the terminal fittings of the coupled terminal unit, an arrangement pitch of the terminal fittings is narrower than an arrangement pitch of the terminal insertion holes in a stamped-out state of the coupled terminal unit from a conductive plate, and the arrangement pitch of the terminal fittings can be made substantially equal to that of the terminal insertion holes by extending the extendible portion.

2. The coupled terminal unit of claim 1, wherein the coupling portion connects adjacent terminal fittings at intermediate positions.

3. The coupled terminal unit of claim 1, wherein the terminal fittings each comprise a widened portion having wider than other portions of the terminal fittings, and wherein the coupling portion connects adjacent terminal fittings at a position at the widened portions thereof.

4. The coupled terminal unit of claim 1, wherein the terminal fittings each comprise a bulging portion to be engaged with the connector housing, and wherein the coupling portion connects adjacent terminal fittings at a position near the bulging portions thereof.

5. A connector assembling method for a connector having a housing with terminal insertion holes arranged at an insertion hole pitch, the method comprising the following steps:

providing a conductive plate with a selected thickness extending along a thickness direction;

stamping and forming the conductive plate to define a coupled terminal unit having a plurality of terminal fittings coupled by at least one coupling portion, the coupling portion being formed into a wavy shape extending in the thickness direction, an arrangement pitch of the terminal fittings being narrower than the insertion hole pitch of the terminal insertion holes the housing of the connector, and at least partly flattening the coupling portion for extending the coupling portion in an arranging direction of the terminal fittings of the coupled terminal unit to make the pitch of the terminal fittings substantially equal to the insertion hole pitch of the terminal insertion holes; and at least partly inserting the terminal fittings of the coupled terminal unit into the terminal insertion holes.

6. The connector assembling method of claim 5, further comprising a step of cutting off the coupling portions after the terminal fittings are at least partly inserted into terminal insertion holes.

7. The connector assembling method of claim 5, wherein the arrangement pitch of the terminal fittings is made substantially equal to that of the terminal insertion holes upon inserting the terminal fittings of the coupled terminal unit into the terminal insertion holes.

8. The connector assembling method of claim 5, wherein the coupled terminal unit is provided such that the terminal fittings each comprise a widened portion having a wider width than other portions of the terminal fittings, and that the coupling portion connects adjacent terminal fittings at a position at or near the widened portions.

9. The connector assembling method of claim 8, wherein the coupling portions are extended by being pressed substantially along the thickness direction.

* * * * *